United States Patent [19]

Davis

[11] Patent Number: 4,915,099

[45] Date of Patent: Apr. 10, 1990

[54] MOULDED SPEECH TRANSMITTER

[75] Inventor: Ronald E. Davis, Kanata, Canada

[73] Assignee: Her Majesty the Queen in right of Canada, as represented by the Minister of National Defence, Ontario, Canada

[21] Appl. No.: 231,397

[22] Filed: Aug. 12, 1988

[30] Foreign Application Priority Data

Feb. 10, 1988 [CA] Canada ..... 558639

[51] Int. Cl.[4] ..... A62B 18/08

[52] U.S. Cl. ..... 128/201.19; 128/206.16

[58] Field of Search ..... 128/201.19, 206.16, 128/206.17

[56] References Cited

U.S. PATENT DOCUMENTS

| | | | |
|---|---|---|---|
| 1,762,695 | 6/1930 | Monro | 128/201.19 |
| 2,038,267 | 4/1936 | Bullard | 128/201.19 |
| 2,845,927 | 8/1958 | Hill | 128/206.17 |
| 3,035,574 | 5/1962 | Lytle et al. | 128/201.19 |
| 4,088,461 | 5/1978 | Brauer | 128/206.17 |
| 4,756,308 | 7/1988 | Ryback | 128/201.19 |

FOREIGN PATENT DOCUMENTS

| | | | |
|---|---|---|---|
| 771504 | 10/1934 | France | 128/201.19 |

*Primary Examiner*—Edgar S. Burr
*Assistant Examiner*—Kimberly L. Asher
*Attorney, Agent, or Firm*—Nixon & Vanderhye

[57] ABSTRACT

A speech transmitter for use in gas masks and the like comprises a body member having a central, circular recess in one end thereof and a marginal rim surrounding the recess, a cover member having a complementary central, circular recess in one end thereof and a marginal rim surrounding the recess, the cover member marginal rim being lockingly engageable with the body member marginal rim so as to form an unitary assembly in which the body recess and the cover recess are in coaxially aligned, face-to-face relation and define a membrane chamber, the marginal rims having mating surfaces adapted to secure and radially tension a membrane therebetween; and a membrane having a marginal edge interposed between the mating surfaces and a main body portion disposed within the membrane chamber.

13 Claims, 2 Drawing Sheets

(b)

(a)

MOULDED SPEECH TRANSMITTER

The present invention relates to an improved speech transmitter for use in protective masks and the like.

BACKGROUND OF THE INVENTION

Armed forces personnel may be required to perform their respective duties with equipment, including facial gas masks, issued for personal protection in contaminated land, sea, or air environments. Rapid and effective verbal exchange of information is essential for the conduct of operations. All mask designs currently in use for this purpose incorporate one or more voice transmitter assemblies in the form of sealed diaphragms. Other common design characteristics include a nosecup/-mouth seal extending from the bridge of the nose, around the mouth and to a chincup. Voice transmission may be directly affected by changes in the design of the nosecup/mouth seal.

Speech transmitters currently fitted into protective masks employ a metal casing which houses a mylar membrane and a specially constructed rubber tension ring to apply a frictional force to the membrane. The tension ring is secured in place by crimping of the entire assembly. Observations have shown that the tensional forces applied to the mylar membrane are not maintained over time resulting in progressive degradation of the quality of speech transmission.

In addition to crimping the assembly, other designs apply tension to the mylar membrane by pulling the edges of the membrane around a radius. Rubber gaskets were introduced to prevent leakage and protect the mylar membrane.

Current designs require a silicone rubber tension ring for each size of speech transmitter. Silicone requires a post curing operation and is relatively expensive. It has been found that mass production of these items has not been possible and, accordingly, costly manual assembly has been required.

SUMMARY OF THE INVENTION

The present invention seeks to provide a speech transmitter which is easily manufactured and assembled and which provides reliability of tension application and sealing effectiveness.

In accordance with the present invention, the body and cover members are formed with interlocking means which engage when the two members are axially pressed together into a unitary or integral assembly. This considerably facilitates assembly of the device. In addition, the members are formed with interlocking surfaces which cooperate during assembly to securely grip the marginal edge of the mylar membrane and subject the membrane to a uniform radial tension. This arrangement avoids the need of a tension ring, seals and/or gaskets and, therefore, considerably facilitates both manufacturing and assembling and reduces costs.

Thus, the present invention is generally defined as a speech transmitter for use in gas masks and the like comprising a body member having a central, circular recess in one end thereof and a marginal rim surrounding the recess, a cover member having a complementary central, circular recess in one end thereof and a marginal rim surrounding the recess, the cover member marginal rim being lockingly engageable with the body member marginal rim so as to form an unitary assembly in which the body recess and the cover recess are in coaxially aligned, face-to-face relation and define a membrane chamber, the marginal rims having mating surfaces adapted to secure and radially tension a membrane therebetween, and a membrane having a marginal edge interposed between the mating surfaces and a main body portion disposed within the membrane chamber.

BRIEF DESCRIPTION OF THE DRAWINGS

These and other features of the invention will become apparent from the following description in which reference is made to the appended drawings, wherein.

DESCRIPTION OF PREFERRED EMBODIMENT

Figure 3:
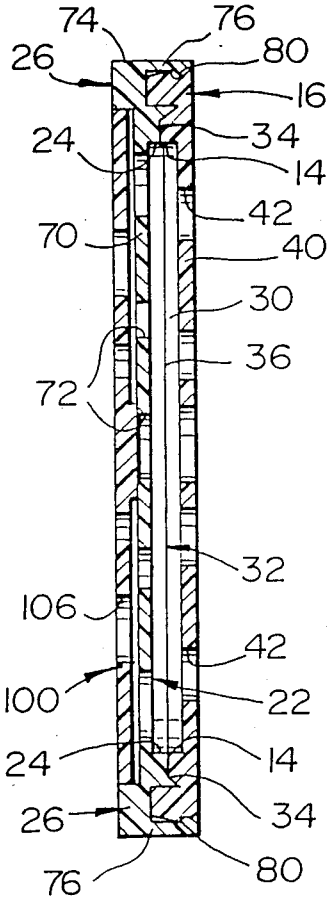
FIG. 3 is a longitudinal cross-sectional view taken along line 3—3 of FIG. 2.

With reference to the drawings, the speech transmitter 10, according to a preferred embodiment of the invention, is comprised of a body member 12 having a central, circular recess 14 in one end thereof and a marginal rim 16 of circumferentially uniform cross-sectional shape surrounding the recess, a cover member 22 having a central, circular recess 24 in one end thereof and a marginal rim 26 of circumferentially uniform cross-sectional shape surrounding the recess. Cover member marginal rim 25 is lockingly engageable with body member marginal rim 16 so as to form, when assembled, a unitary or integral assembly with the body recess and the cover recess being in coaxially aligned, face-to-face relation defining a membrane chamber 30. As explained in greater detail below, the marginal rims are formed with mating surfaces adapted to both secure and tension a circular mylar membrane 32 therebetween. As best shown in FIG. 3, the marginal portion 34 of the membrane is interposed between the rims of the body and cover members while a main body portion 36 thereof is disposed in membrane chamber 30.

Figure 1:
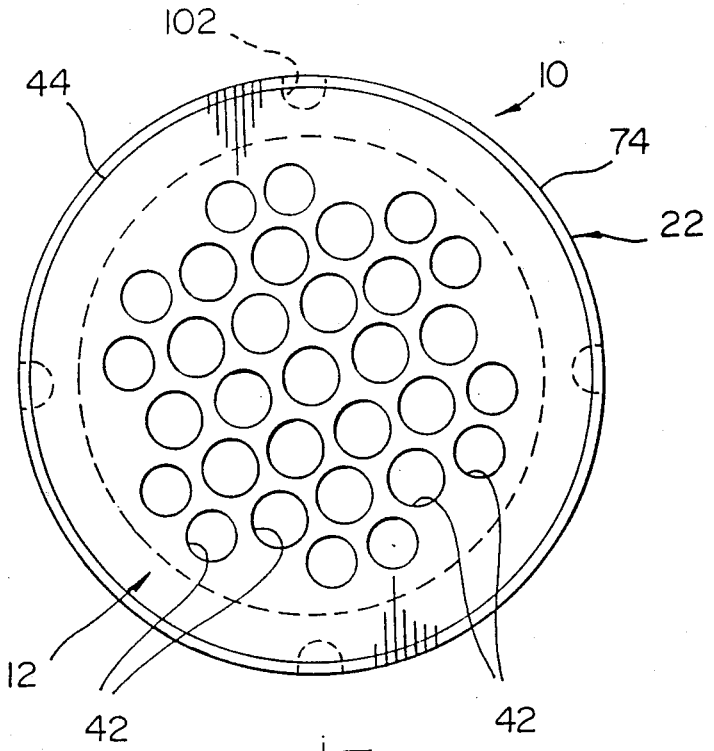
FIG. 1 is a right side elevational view illustrating an apertured body member of a speech transmitter according to a preferred embodiment of the present invention.
Figure 4:
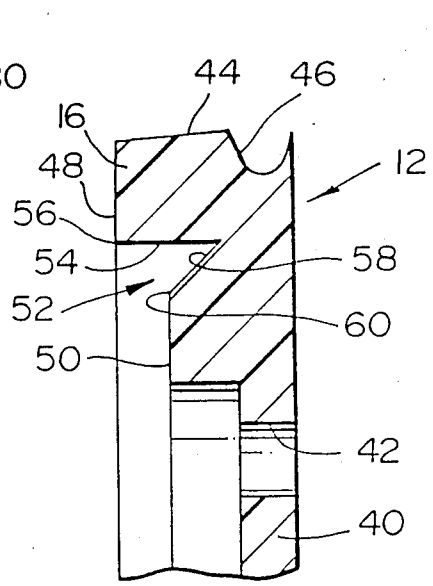
FIG. 4 is an enlarged, partially broken cross-sectional view similar to FIG. 3 but illustrating the membrane securing and tensioning mechanism in greater detail.
Figure 4:
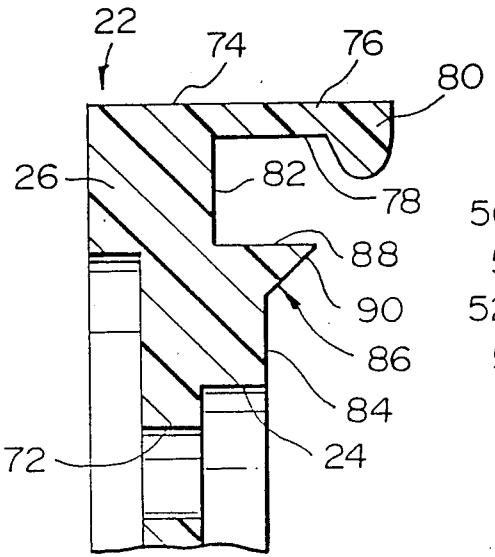

With reference to FIGS. 3 and 4, the main body portion 40 of body member 12 is thin and planar and formed with a plurality of apertures or holes 42, as best shown in FIG. 1, to allow acoustical pressure waves access to membrane chamber 30. Marginal rim 16 of body member 12 includes an outer edge 44 in which there is formed a circumferentially, outwardly facing semicircular recess 46 and which tapers inwardly to facilitate telescopic insertion of rim 16 into a flange in the cover member as described later. The inner face of rim 16 is formed with a pair of planar radial surfaces 48 and 50 which are axially spaced from one another and between which there is formed a generally triangular, annular recess 52. Recess 52 includes a cylindrical surface 54 which extends axially inwardly from the inner edge 56 of outer planar surface 48 and a conical surface 58 which extends from the end of surface 54 remote from surface 48 to the outer edge 60 of inner planar surface 50.

Figure 2:
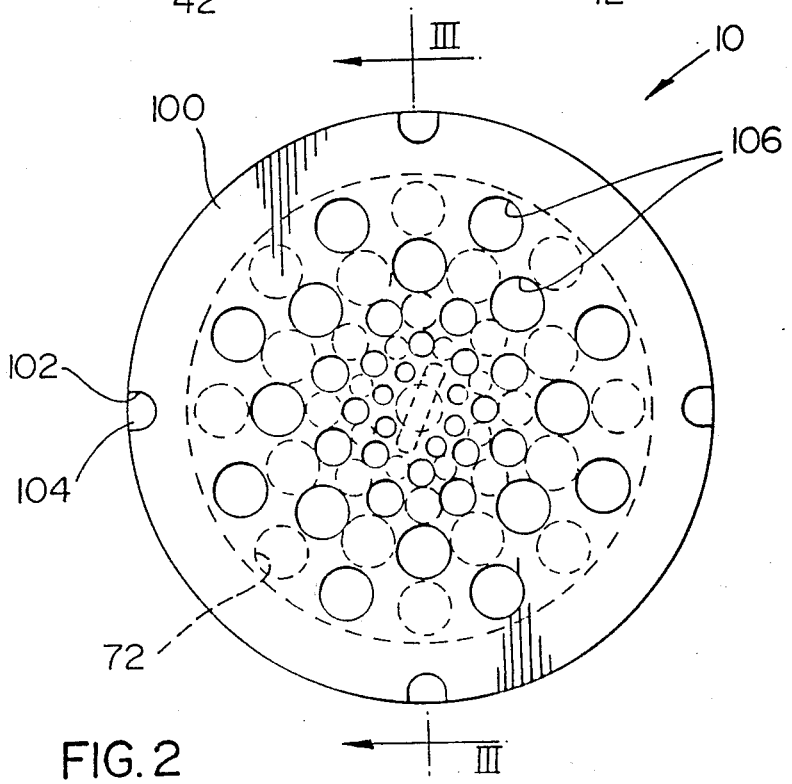
FIG. 2 is a left side elevational view illustrating an apertured protective cover secured to the cover of a speech transmitter according to a preferred embodiment of the present invention.

The main body portion 70 of cover member 22 is thin and planar and formed with a plurality of apertures or holes 72, as best shown in dotted lines in FIG. 2, to allow acoustical pressure waves access to membrane chamber 30. Marginal rim 26 of cover member 22 includes an outer edge 74 in which there is formed a tubular flange 76 having an inner cylindrical surface 78 which terminates in a circumferential, inwardly extending, semi-cylindrical bead or detent 80. Detent 80 is adapted to be received in recess 46 of the body member. The inner face of rim 26 is formed with a pair of planar radial surfaces 82 and 84 which are axially spaced from one another and between which there is formed a generally triangular, annular projection 86. Projection 86 includes a cylindrical surface 88 which extends axially outwardly from the inner edge of inner planar surface 82 and a conical surface 90 which extends from the end of surface 88 remote from surface 82 to the outer edge of outer planar surface 84.

A disc shaped protector 100 (FIGS. 2 and 3) is secured to the cover member 22 on the side thereof remote from body member 12. The protector is formed with four equally angularly spaced notches 102 adapted to receive mating tabs or projections 104 extending from the cover member. In addition, the protector is formed with a plurality of axial holes or apertures 106, as best shown in FIG. 2, for communicating acoustical pressure waves into and out of the membrane chamber.

Body member 12, cover member 22 and protector 100 are formed of a thermoplastic material so that they can be readily and easily moulded into the shapes described hereinabove using conventional manufacturing techniques and thereby considerably facilitate assembly of the speech transmitter. Thus, in order to assemble the speech transmitter, the outer edge of the circular mylar membrane is placed between rims 16 and 26 of the body and cover members and then the two members are pressed axially against one another. As this occurs, the outer flange 76 of the cover member will flex radially outwardly as the bead slides onto and along the tapered outer edge of the cover member until bead 80 seats within its mating recess 46 in the cover. This interengagement securely holds the two members as a unitary assembly.

In the meantime, the planar surfaces, annular projection 86 and mating recess 52 grasp the membrane and, as the body and cover members continue to move towards one another, the conical inclined surfaces apply a uniform radially outward pull to the membrane, placing it under a suitable tension.

Thus, it will be seen that the present invention is cost effective in that it can be readily constructed using conventional moulding and production techniques and allows for faster and easier assembly with lower incidence of rejects. In addition, no gasket or silicone tensioner is required to seal or aid in the tensioning of the mylar.

It will be understood that various modifications and alterations may made to the above described preferred embodiment without departing from the spirit of the invention as defined by the appended claims.

The embodiments of the invention in which an exclusive property or privilege is claimed are defined as follows:

1. A speech transmitter, comprising:

a disc shaped body member halving a concentric, central circular recess in one end thereof and an outer, axially extending marginal rim surrounding said recess;

a disc shaped cover member having a concentric, central, circular recess in one end thereof and an outer, axially extending marginal rim being lockingly engageable with said body member marginal rim in axial relation thereto, said body recess and said cover recess being in coaxially aligned face-to-face relation and defining a membrane chamber; and a thin, circular, membrane having a main body portion disposed in said membrane chamber and a marginal edge portion secured between said outer marginal rims of said body member and said cover member, said marginal rims having mating surface means comprising an annular projection and a corresponding recess for receiving said annular projection, said annular projection and mating recess having inclined surfaces, arranged such that when the marginal edge portion of said membrane is placed therebetween and said members are assembled by being telescoped into axial interengagement with one another, said inclined surface cooperate during said assembly to securely grip said marginal edge and radially outwardly pull said membrane to subject said membrane to uniform radial tension.

2. A speech transmitter as defined in claim 1, one of said marginal rims having a circumferential annular locking bead and the other of said marginal rims having an circumferential annular locking recess interlockingly engageable with said locking bead for preventing axial separation of said body and cover members.

3. A speech transmitter as defined in claim 2, said one of said members having a longitudinally extending, tubular flange extending from the marginal rim thereof and adapted to telescopically receive the outer periphery of the other of said members, said bead extending radially inwardly of an inner surface of said flange and said annular recess being formed in said outer periphery of the other of said members.

4. A speech transmitter as defined in claim 3, said mating surface means including, on said body and cover members, complementary inner and outer axially displaced planar radial surfaces, a cylindrical surface extending axially form the inner edge of said outer surface, and a conical surface extending inwardly from the end of said cylindrical surface remote from said outer surface to the outer edge of said inner surface.

5. A speech transmitter as defined in claim 4, said cylindrical and conical surfaces of one of said members defining a membrane locking projection and the cylindrical and conical surfaces of the other of said members defining an membrane locking recess adapted to receive said membrane locking projection.

6. A speech transmitter as defined in claim 1, each said body and cover members having apertures for communicating acoustical pressure waves to enter and egress from said acoustical chamber.

7. A speech transmitter as defined in claim 1, said body and cover members being formed of thermoplastic material.

8. A speech transmitter, comprising:

a disc shaped moulded thermoplastic body member having a concentric, central, circular recess in one end thereof defining an outer, axially extending marginal rim of uniform cross-sectional shape surrounding said recess, said rim including:

an outer edge having a circumferential, semicircular, radially outwardly extending recess therein;

a pair of axially displaced, radially extending planar surfaces; and a right-triangular conical recess intermediate said pair of planar surfaces;

a disc shaped moulded thermoplastic cover member having a concentric, central, circular recess in one end thereof defining on outer, axially extending marginal rim of uniform cross-sectional shape surrounding said recess, said cover member marginal rim being adapted to lockingly engage said body member marginal rim in axial relation thereto with said body recess and said cover recess being in coaxially aligned face-to-face relation and defining a membrane chamber, said cover marginal rim including:

a cylindrical marginal flange having an inner cylindrical surface adapted to telescopically receive said outer edge of said body member in close fit relation, a circumferential, semicircular bead extending radially inwardly from the free end of said inner surface of said flange and being adapted to be received in interlocking relation with said semi-circular recess in said outer edge of said body member;

a pair of axially displaced, radially extending planar surfaces adapted to be disposed in abutting relation with said pair of axially displaced, radially extending planar surfaces of said body member; and a right-triangular projection intermediate said pair of planar surfaces of said cover and adapted to be received within said conical recess of said body member;

and a thin, circular, membrane having a marginal portion interposed between said pair of planar surfaces and said right-triangular recess of said body and said pair of mating planar surfaces and said right-triangular projection of said cover member and a main body portion disposed in said membrane chamber.

9. A speech transmitter as defined in claim 8, said mating surfaces having an undulating shape arranged such that when the periphery of said membrane is placed therebetween and said members are bought into axial interengagement with one another, said membrane is uniformly radially tensioned by and secured to said surfaces.

10. A speech transmitter as defined in claim 9, each said undulating planar surfaces including:

inner and outer, axially displaced, annular, planar radial surfaces;

a cylindrical surface extending axially from the inner edge of said outer surface; and a conical surface extending inwardly from the end of said cylindrical surface remote from said outer surface to the outer edge of said inner surface.

11. A speech transmitter as defined in claim 10, said cylindrical and conical surfaces of one of said members defining a membrane locking projection and the cylindrical and conical surfaces of the other of said members defining a membrane locking recess adapted to receive said membrane locking projection.

12. A speech transmitter as defined in claim 11, each said body and cover members having apertures for permitting acoustical pressure waves to enter and leave said acoustical chamber.

13. A speech transmitter as defined in claim 12, said body and cover members being formed of thermoplastic material.

* * * * *